United States Patent [19]

Schadow

[11] 4,283,609

[45] Aug. 11, 1981

[54] ELECTRICAL SNAP-ACTION SWITCH

[75] Inventor: Rudolf Schadow, Berlin, Fed. Rep. of Germany

[73] Assignee: ITT Industries, Inc., New York, N.Y.

[21] Appl. No.: 935,636

[22] Filed: Aug. 21, 1978

[51] Int. Cl.[3] ..... H01H 13/52

[52] U.S. Cl. ..... 200/67 D; 200/159 A; 200/303

[58] Field of Search ..... 200/5 A, 67 D, 159 A, 200/292, 67 DA, 159 B, 159 R, 293, 303

[56] References Cited

U.S. PATENT DOCUMENTS

| | | | |
|---|---|---|---|
| 2,701,475 | 2/1955 | Readeker | 200/67 D |
| 2,861,142 | 11/1958 | Millerwise | 200/67 DA |
| 4,146,767 | 3/1979 | Murata | 200/159 B |

FOREIGN PATENT DOCUMENTS

| | | | |
|---|---|---|---|
| 1086779 | 8/1960 | Fed. Rep. of Germany | 200/67 DA |
| 2740902 | 3/1979 | Fed. Rep. of Germany | 200/67 D |

*Primary Examiner*—John W. Shepperd

*Attorney, Agent, or Firm*—James B. Raden; William J. Michals

[57] ABSTRACT

Snap action switch with a sheet metal spring divided by slots into two or three coherent strips, one of which is shortened by way of bending. The bending is effected by clamping the strip between abutments formed by the upper and lower part of the housing. In this way a definite bending of the sheet metal spring is obtained.

3 Claims, 7 Drawing Figures

ELECTRICAL SNAP-ACTION SWITCH

BACKGROUND OF THE INVENTION

The present invention relates to an electrical snap-action switch comprising a snapping spring made of sheet metal divided into at least two strips extending in parallel with one another, with these strips being joined to one another at both ends by cross webs, and of which at least one strip is unshortened, and at least one other strip is shortened by means of a bending, with the sheet metal carrying at least one electric contact being designed to cooperate with an opposite contact arranged on a flat base, and in which there is provided an actuating device by which the unshortened strip can be caused to snap over.

Electrical snap-action switches have already become known, in which as the snapping element there is used a spring plate which is divided by slots into several strips extending in parallel with one another, and which are joined to one another by cross webs at both ends. If, in the case of such a spring plate, at least one strip is shortened by way of bending or arching, and when at least one other strip is unshortened, the unshortened strip is arched towards one side, thus causing the spring plate to become distorted. With the aid of a suitable actuator, it is now possible to exert a pressure upon the unshortened strip causing the latter to snap over to the other side of the plate's plane. This snap over process may be utilized for closing or opening electrical contacts, with a switch being obtained in this way, whose contacts can be rapidly closed and opened, i.e. independently of the actuation by the actuator. In this way there is not only always established a clearly defined switching condition, but also the sparking between the contacts to be switched is extensively suppressed. Such a type of snap-action switch has become known, for example, from the German Pat. No. 458,899. The flat spring that snaps the contacts in this conventional type of switch consists of three sheet metal strips which are joined to one another and their ends, with the two outer strips each being shortened by two archings formed therein, while the center strip remains unshortened and can be caused to snap over.

Another snap-action switch of this type has become known from the German Pat. No. 912,597, in which there is likewise used a flat snapping spring of three strips connected to one another, of which the two outer strips are each shortened by means of bendings.

From the German Pat. No. 1,806,807 there is known a further electrical snap-action switch in which the flat snapping spring is obtained in that two U-shaped recesses are punched out, and by folding the sheet metal and hooking the individual parts into one another. In this case, the distortion is not only obtained by way of deforming the individual parts of the sheet metal spring, but also by hooking the bent-off sheet metal members into one another.

From the German Published Patent Application (DT-OS) No. 2,356,024 there is known a keyboard in which the individual snap-action switches are provided with flat snapping springs which are clamped at one end, and in which the flat snapping spring as divided into strips, is distorted by providing for shortenings of the outer strips.

In the push button switch according to the German Published Patent Application (DT-OS) No. 2,411,426 there is likewise used a flat snapping spring divided by slots into three coherent strips, with the two outer strips thereof being shortened by means of bendings. The unshortened strip in the center is provided in this case with L-shaped extensions carrying the contacts.

Finally, applicant's earlier German Patent Application No. P 25 37 905 covers an electrical snap-action switch comprising a snapping spring which is divided into strips, with contacts being provided for in the snapping spring on at least one strip, and the snapping spring being extended in the direction of the strips, and beyond the connecting web of the strips in such a way as to form extensions with contacting points, and the snapping spring, at least within the area of the connecting web extended by the extension, being mounted capable of being swivelled about an axis extending almost vertically in relation to the strip.

In all of these conventional or proposed types of embodiment, the stripwisely divided flat snapping spring plate is shortened by way of bendings on at least one strip, and is thus distorted. Common practice has shown, however, that it is very difficult to produce snapping spring plates having reproducible properties, and in particular, that it is difficult to produce snapping spring plates for smaller types of switches in such a way that all of the manufactured snapping spring plates have the same snap-over characteristic. For manufacturing such snapping spring plates it is necessary to use a hard spring material having very specific spring or elastic qualities. For effecting the shortening, however, it is necessary to bend the sheet metal over a sharp bending edge and to employ a considerable overbending force in order to obtain the desired remaining deformation. This deformation, however, is strongly dependent upon the material itself, of its thickness and its hardness. Moreover, the acute-angled prebending substantially reduces the service life of the flat spring. If, on the other hand, deformations having a large bending radius are used, which is anyway only possible in the case of larger snapping spring plates, the sheet metal material is not stressed to the same extent when producing the deformation, but it has proved that the thus produced deformation does not remain constant, and in fact varies in the course of time. This, however also changes the snapping properties of the sheet metal material, which are dpendent upon the size of the shortening and, consequently of the distortion of the sheet metal spring. Obviously, when producing the shortening, the internal structure of the sheet metal is substantially changed at the bending point, with this having a substantial influence upon the mechanical stability and the elastic properties of the sheet metal material. This may well be one of the reasons for the fact that it is extremely difficult with manufactured snapping spring plates, to produce the required shortenings in such a way that the thus obtained flat snapping spring plates all have the same snapping properties. As already denoted hereinbefore, there is still to be added that the change in the properties of the material caused by the produced bending, is still dependent on slight thickness variations in the sheet metal, as well as upon deviations regarding the hardness of the individual sheet metals. It has proved that even when using sheet metals showing to have only very slight deviations in their thickness, and very uniform elastic properties, the flat snapping spring plates which are obtained after the deformation has been effected, still have considerable deviations with regard to the snapping properties. This, however, is noticed very disturbingly in cases where a keyboard is constituted of a large number of such snap-action switches, with the snapping properties of the individual flat snapping spring plates still being subject to variations or changes during the time they are used. In this respect it still has to be considered that in the case of relatively small snap-action switches, the actuating paths are only very small.

It is the object of the present invention to provide snap-action switches of the type mentioned hereinbefore, avoiding the difficulties in manufacturing the formed-in shortening, and which have reproducible and uniform snapping properties.

SUMMARY OF THE INVENTION

According to the invention, this object is achieved in that the bending of the shortened strips is effected by clamping them between abutments. It was found that when a strip is shortened by being clamped between abutments, it is possible to achieve very exactly reproducible snapping properties, which was not at all possible with the hitherto conventional types of formed-in shortenings. In addition, there is saved the difficult process of producing formed-in shortenings of the spring sheet metal, and the deformation is only carried out when the switch is assembled, in that then one or more strips of the sheet metal are clamped between abutments. Accordingly, the invention is not concerned with a continuous deformation of the sheet metal strips for the purpose of shortening the latter, but with a shortening by way of clamping between abutments which is cancelled again when removing the sheet metal from the abutments. Owing to the fact that the deformation in this case can be carried out in a relatively large bending radius, there is not caused any structural change in the sheet metal material, so that also the elastic properties are not subjected to any change. However, by being clamped between abutments, the bending radius of the deformation is kept permanently constant, so that also the snapping properties remain constant. In manufacturing the shortening, there is caused no overbending of the sheet metal material causing the aforementioned disadvantages.

According to one advantageous type of embodiment of the invention, the abutments are combined to form one single structural part.

A further advantageous type of embodiment of the invention resides in the fact that the abutments are formed by the switch housing itself, i.e. are preferrably molded partly to one top part of the housing, and partly to one bottom part of the housing.

Preferably, there are provided three abutments of which one is arranged on one side of the strip to be shortened, almost in the center thereof, while the two others are arranged on the other side of the strip to be shortened, i.e. on either side of the first abutment.

Moreoever, it is of advantage to design at least one abutment as a contact, especially to form two abutments by the housing, and one abutment as a current lead-in for the flat snapping spring plate.

Preferably, the bottom part of the housing is formed by a plate on which a printed circuit is arranged. This printed circuit is laid out either for one or more switch elements. Accordingly, also several abutments are provided, each with a current lead-in and fixed contact. On this plate (board) a corresponding number of top parts of the housing are mounted by way of snap action, with one flat snapping spring plate each being arranged between these top parts of the housing and the plate (board). In this way as many switches units are obtained on one common plate (board) as are required, for example, for electronic pocket calculators.

Moreover, it is of advantage to design the top part of the housing partly in a diaphragm-like manner, and to form in the center of the diaphragm a member for actuating the sheet metal. Thus, there is only required a minimum of parts of assembling the switch.

As is known per se, an L-shaped strip may be molded to the unshortened strip, with the long leg thereof extending into the free space between the strips, and with the free end thereof carrying a contact.

In the switch according to the invention, the flat snapping spring plate rests on a plane base carrying the opposite contacts. Such a switch comprises make contacts which are closed upon actuation. In many cases, however, it is desirable to open a second contact simultaneously when one contact is closed. Therefore, the sheet metal must be so designed that one part, i.e. the part carrying the contact, is caused to snap over in the opposite direction. According to the further embodiment of the invention, this is accomplished in that below one cross web of the sheet metal, an elevation is arranged on the plane (flat) base, on which the cross web is permitted to rest, and that the sheet metal is extended beyond this cross web, with the extended part carrying a contact lying opposite a fixed contact arranged on the base.

The elevation as arranged on the base, however, may also be formed by a contact itself, which is of a raised or embossed design, and arranged on the sheet metal or on the base.

Finally, two sheet metals may be arranged next to each other on the base in such a way that they can be actuated by an actuator common to both. In this way it is possible to simultaneously close and open several contacts which are independent of one another.

BRIEF DESCRIPTION OF THE DRAWING

Advantageous types of embodiments of the invention will now be explained in greater detail with reference to FIGS. 1 to 7 of the accompanying drawings, in which.

DETAILED DESCRIPTION

Figure 1:
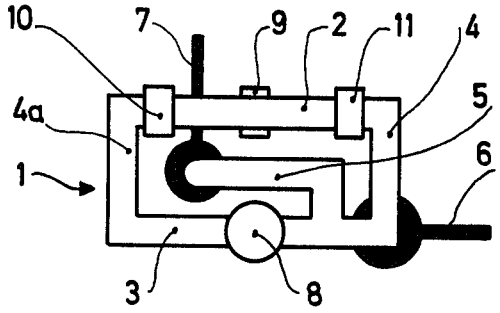
FIG. 1 shows a flat snapping spring plate for use with a snap-action switch according to the invention, employing abutments and contacts.

The spring sheet or snapping spring 1 as shown in FIG. 1 has two strips 2 and 3 which are joined at their ends to one another by the cross webs 4 and 4*a*. The strip 2 is shortened by being clamped between abutments, while the strip 3 is unshortened and, owing to the distortion of the sheet metal, arched upwardly towards one side. The abutments for clamping the strip 2 may consist of two curved parts lying opposite each other, between which the strip 2 is clamped in position. In most cases, however, it will be sufficient to employ three abutments, as is shown in FIG. 1. One abutment 9 may be arranged almost in the center of the strip 2 on one side, while the two other abutments 10 and 11 are arranged on both sides of the abutment 9 on the opposite side of the sheet metal member. By a suitable mutual position of the abutments there is produced the desired bending of the strip, thus achieving the shortening. Owing to the fact that the two abutments 10 and 11 are arranged either more distantly from the center abutment 9, or nearer thereto, it is possible to change the snapping characteristic of the sheet metal member. The sheet metal member as such is arranged on a plane base carrying the contacts. In the arrangement according to FIG. 1, the fixed contact 6 serves as the current lead-in conductor for the sheet metal member 1 while the fixed contact 7 cooperates with a contact arranged at the end of the L-shaped strip 5. When a pressure is exerted by means of an actuating device 8 upon the unshortened strip 3, the latter is caused to snap over, thus bringing the contact at the end of the L-shaped strip 5 in touch with the fixed contact 7 so that the circuit is closed between 6 and 7. After the pressure of the actuating device 8 upon the strip 3 has ceased, the sheet metal member snaps back to its original position, thereby lifting the L-shaped strip 5 off the fixed contact 7, thus interrupting the circuit between 6 and 7.

Figure 2:
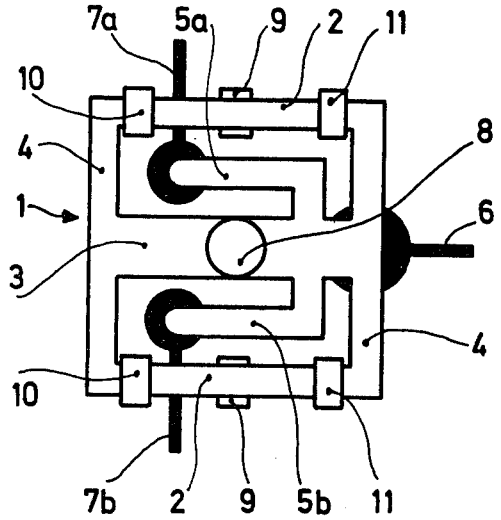
FIG. 2 shows a modified type of embodiment of a flat snapping spring plate for use with a snap-action switch according to the invention.

In the type of embodiment according to FIG. 2, the snapping sheet metal spring has three strips which are all joined to one another, with the two outer strips 2 being shortened by the abutments 9, 10 and 11 while the center strip 3 is unshortened and carries two L-shaped extensions 5*a* and 5*b* which cooperate with the fixed contacts 7*a* and 7*b*. Power is supplied to the snapping spring sheet via the fixed contact 6 on the plane base. By the actuating device 8 the center strip 3 is caused to snap over, thus closing the contacts between 5*a* and 7*a* or 5*b* and 7*b*.

Figure 3:
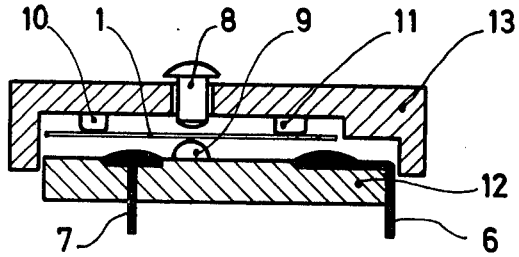
FIGS. 3 and 4 are sectional views of a snap-action switch according to the invention, i.e. prior to and after the final assembly.
Figure 4:
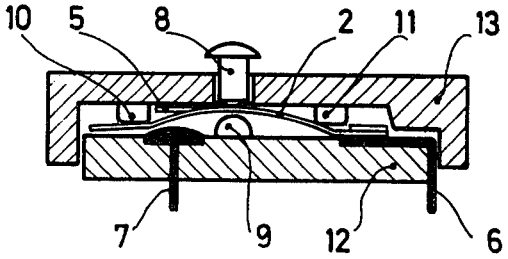

FIGS. 3 and 4 each show a section taken through a further advantageous type of embodiment of the invention, with the abutments being formed into the housing. In this type of embodiment the housing consists of a top part 13 and of a bottom part 12. The bottom part 12 of the housing is constituted by a plane base on which the fixed contacts are arranged. The top part 13 of the housing is of cap-like design and firmly connected to the bottom part 12 of the housing when being assembled. As can be recognized from FIGS. 3 and 4, the two abutments 10 and 11 are molded to the top part 13 of the housing while the abutment 9 is molded to the bottom part 12 of the housing. The top part of the housing is provided with an opening through which the push button 8 is inserted, serving as the device for actuating the flat snapping spring plate. During the assembly, the flat snapping spring plate 1 is in such a way inserted between the top part 13 and the bottom part 12 of the housing, that the strip to be shortened will come to lie between the two abutments 10 and 11 and the abutment 9. This state is shown in FIG. 3. Subsequently thereto, the top part 13 of the housing is pressed on to the bottom part of the housing until meeting against a firm limit stop, thus causing the strip 2 of the snapping spring plate to be distorted among the abutments 9, 10 and 11. Now the actuating device 8 is positioned opposite the unshortened strip 3, and the switch is ready to operate.

Figure 5:
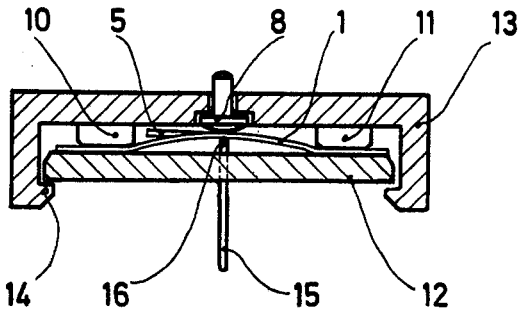
FIG. 5 is the sectional view of a modified type of embodiment of the invention; and, FIGS. 6 and 7 show a further type of embodiment of a snap-action switch according to the invention, i.e.

Another type of embodiment of the snap-action switch according to the invention is shown in a sectional view in FIG. 5. This type of embodiment in which likewise the one strip of the snapping spring plate is clamped between two abutments 10 and 11 molded to the top part 13 of the housing, and an abutment 16 on the bottom part 12 of the housing, differs insofar from the type of embodiment described hereinbefore, as the one abutment is formed by a fixed contact 15 which is so arranged in the bottom part 12 of the housing, as to project with a defined length over the surface of the bottom part 12 of the housing. When assembling both the top part 13 and the bottom part 12 of the housing, the sheet metal member 1 is deformed with its strip 12 between the abutments 10 and 11, and is thus shortened.

The two parts 12 and 13 of the housing can be joined to one another in a simple way, in that the rim portion of the part 13 of the housing is provided with engaging or stop extensions 14 snapping in at the rim portion of the bottom part 12 of the housing. For being assembled, the snapping spring plate only needs to be placed on to the bottom part of the housing or into the top part of the housing, where it is secured in position by corresponding projections, until the engaging or stop extensions 14 snap in behind the bottom part 12 of the housing. In this way there is obtained a switch which is not only of simple design and consists of a small number of parts, but which is also very easy to assemble, and whose flat snapping spring plate has constant and reproducible snap action properties.

According to FIG. 5, the bottom part 12 of the housing can be replaced by a printed circuit board, with the latter appropriately serving several snap-action switches in common. Into the printed circuit board the abutments 16 are inserted as raised fixed contacts 15, with the same also applying to the fixed contacts 7 in as far as they are not printed on the board as well. In that case merely the top parts 13 of the housings with the inserted actuating device 8 and the snapping spring plate 11 have to be placed thereon, with the engaging or stop extensions 14 engaging in the corresponding holes provided for in the printed circuit board.

A further simplification will still result when the cover of the top part 13 of the housing is designed elastically from a plastic material around the actuating device 8 which, in this particular case, will have to be molded thereto in one piece. This is possible in a relatively easy manner by providing the surroundings of the device with an undulated weakening of the material stock.

Figure 6:
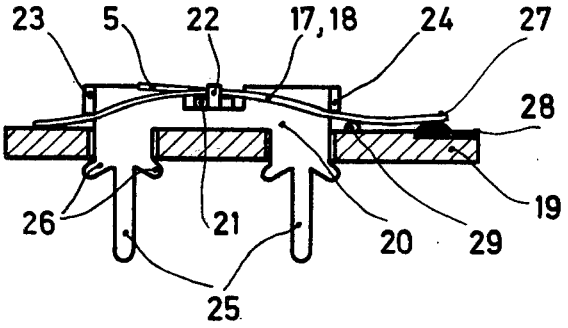
FIG. 6 shows the switch in a section taken on line A—A of FIG. 7.
Figure 7:
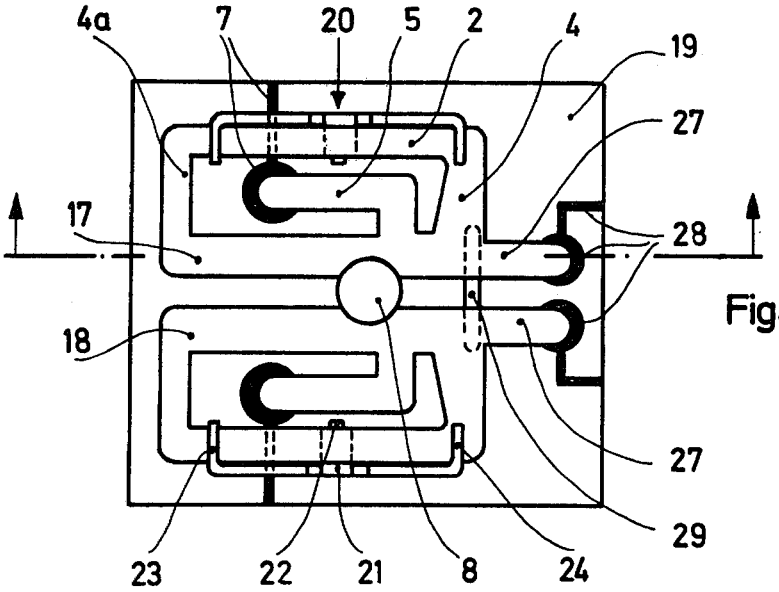
FIG. 7 shows the switch in a top view.

FIGS. 6 and 7 show a further advantageous type of embodiment of the invention in which two flat snapping spring plates are arranged next to each other on a base plate 19 common to both. FIG. 7 shows a top view of this snap action switch, and FIG. 6 is a section taken along the line A—A of FIG. 7.

In this type of embodiment the three abutments are combined to form one single structural part 20 which preferably consists of a conductive material, such as metal. This structural part has three rectangularly bent off arms 21, 23 and 24 between which the arched strip 2 is inserted, so that the two arms 23 and 24 will be arranged above, and the arm 21 below the strip 2. The arm 21 serving as the central abutment, is preferably still provided with a stop nose 22 angled off therefrom, so that the sheet metal is immovably retained in the abutment-forming structural part 20. This structural part forming the abutment may be secured in the base plate 19 in a simple way by upsettings 26 molded thereto, while the ends 25 may be designed as connecting lugs. This is evident from FIG. 6.

As is shown in FIG. 7, two snapping spring plates are arranged next to each other in this type of embodiment, on a base plate 19 common to both. The arrangement is made in such a way that the two unshortened strips 17 and 18 will come to lie next to each other so that they can be actuated by an actuating device 8 common to both.

In this type of embodiment, moreover, there is still provided on the base plate 19 a support bearing rib 29, on which the cross webs 4 of both sheet metal members are permitted to rest. The sheet metal members are extended beyond these cross webs by the contact arms 27 carrying contacts at their ends, which are thus in opposition to the corresponding contacts 28 on the base plate 19. Instead of the support bearing rib 29 it is also possible to provide two individual bosses or elevations below the cross webs 4 of the two sheet metal members, which may be formed, if so required, by raised contacts on either the flat snapping spring plate or on the base plate 19. In this way there is obtained a snap action switch of very simple design comprising two break contacts and two make contacts, with each time one break and make contact being galvanically separated from the other break and make contact. When depressing the actuating device 8, the two unshortened strips 17 and 18 are caused to snap over so that the L-shaped strips 5 come into contact with the fixed contacts 7 while the contact arms 27 are lifted off the contacts 28 by a tilting of the sheet metal member on the support bearing rib 29, thus causing these contacts to be opened.

What is claimed is:

1. An electrical snap-action switch comprising a snapping spring made of sheet metal divided into at least two strips extending in parallel with one another, with the strips being joined to one another at both ends by cross webs, and of which at least one strip is unshortened, and at least one other strip is shortened by means of a bending, with the sheet metal carrying at least one electric contact cooperating with an opposite contact arranged on a flat base, and in which there is provided an actuating device by which the unshortened strip can be caused to snap over, and including means for clamping said other strip between abutments so that said bending is thereby provided, and wherein the abutments are formed by the switch housing.

2. Snap-action switch as claimed in claim 1, wherein the abutments are partly molded to a top part of the housing and partly to a bottom part of the housing.

3. Snap-action switch as claimed in claim 2, wherein the top part of the housing is provided in the shape of a diaphragm, with an actuating member for the sheet metal being molded to the center of the diaphragm.

* * * * *